US006234104B1

(12) United States Patent
Guard

(10) Patent No.: US 6,234,104 B1
(45) Date of Patent: May 22, 2001

(54) HULL FOR A SHALLOW WATER FISHING BOAT

(76) Inventor: Paul P. Guard, 422 SW 38th Ave., Cape Coral, FL (US) 33991

( * ) Notice: Subject to any disclaimer, the term of this patent is extended or adjusted under 35 U.S.C. 154(b) by 0 days.

(21) Appl. No.: 09/489,813

(22) Filed: Jan. 24, 2000

Related U.S. Application Data

(60) Provisional application No. 60/117,179, filed on Jan. 25, 1999.

(51) Int. Cl.[7] ..... B63B 1/00
(52) U.S. Cl. ..... 114/271
(58) Field of Search ..... 114/271, 355, 114/357, 358

(56) References Cited

U.S. PATENT DOCUMENTS 2,887,978 * 5/1959 Tritt ..... 114/271
5,134,949 * 8/1992 Almog et al. ..... 114/271

* cited by examiner

*Primary Examiner*—Jesus D. Sotelo
(74) *Attorney, Agent, or Firm*—William E. Noonan

(57) ABSTRACT

An improved shallow water fishing boat hull includes a generally S-shaped chine segment having a sloped intermediate portion that is intersected by the mean waterline. One or more generally Shaped strake elements may be formed along the hull adjacent to the chine segment. Due to the chine configuration, the bottom of the hull intersects the plane of the water at an increased angle so that unwanted and fish distracting hull noise is reduced. The chine segment and the strakes also form spray deflectors.

16 Claims, 4 Drawing Sheets

HULL FOR A SHALLOW WATER FISHING BOAT

RELATED APPLICATION

This application claims the benefit of U.S. Provisional Patent Application Serial No. 60/117,179 filed Jan. 25, 1999.

FIELD OF THE INVENTION

This invention relates to an improved hull for a shallow water fishing boat, which generates significantly less noise and water spray than conventional shallow water boat hulls.

BACKGROUND OF THE INVENTION

Conventional shallow water boats exhibit a number of problems that reduce their effectiveness, particularly when, used in fishing applications. Virtually all vessels of this type employ a chine. This is the portion of the hull that forms the junction between the side and bottom of the hull. The chine normally extends as smooth, shallow curve along each side of the hull. Under most conditions, a portion of the bottom of the hull proximate the bow of the vessel rises above the mean waterline. At the point where the chine intersects the waterline, a shallow void or space is formed between the surface of the water and the bottom of the hull. Typically, the hull bottom forms an angle of approximately 5 to 10 degrees with the plane of the water. Waves and ripples within this space tend to strike the hull and generate a slapping sound.

Shallow water fishing boats also normally employ one or more strakes, which are molded in the bottom of the hull, and serve to improve maneuverability of the vessel. Conventional strakes likewise utilize a smooth curve and rise at a gentle angle above the waterline toward the bow of the boat. This provides even more bottom surface area for the rippling water to strike.

The slapping noise produced by water striking the hull bottom and strakes is disturbing to the fisherman and, more importantly, tends to distract schools of fish. Fish hearing the water impacting the bottom of the vessel are very likely to veer away from the sound. This can adversely affect the boaters ability to catch fish. In many conventional boats a substantial portion of the gently curved chine extends above the mean waterline so that a relatively large, sound producing surface is formed along the bottom of the hull.

Standard shallow water fishing boats also tend to generate a significant and annoying amount of spray. As the hull maneuvers through the water, water is sprayed by the hull upwardly and into the interior of the boat. This can obviously be messy and uncomfortable for occupants of the vessel.

SUMMARY OF THE INVENTION

It is therefore an object of this invention to provide an improved boat hull specifically designed for use on shallow water fishing vessels.

It is a further object of this invention to provide a shallow water boat hull that is constructed to substantially reduce the amount of noise created by water slapping against the hull so that fish are not frightened away and significantly improved fishing results are achieved.

It is a further object of this invention to provide a boat hull that generates a reduced amount of spray.

It is a further object of this invention to provide a shallow water boat hull employing a chine and strake construction that serves to significantly reduce boat hull noise and spray.

It is a further object of this invention to provide a shallow water boat hull that achieves much quieter and drier results than conventional boat hulls and which is also effectively maneuverable, especially in shallow water fishing applications.

This invention features a shallow water boat hull. Each side of the hull includes a generally S-shaped chine segment that extends longitudinally between a forward (bow) section and a rearward (stem) section of the hull. The chine segment divides a side portion of the hull from a bottom portion of the hull. Each chine segment includes sharply curved intermediate portion through which the mean waterline extends during normal operation of the boat. The curved intermediate portion of the chine segment and an adjacent portion of the hull bottom form an angle of at least 26 degrees with the horizontal plane of the water.

In a preferred embodiment, the chine and the adjacent bottom surface of the boat hull intersect the mean waterline such that the curved intermediate portion of the chine and the adjacent bottom surface of the boat hull forward of the mean waterline form an angle of between 28 and 34 degrees with the horizontal plane of the water. Such an angle significantly reduces the impact of ripples and waves against the bottom of the hull and resulting noise. The chine segment may include a branch portion that splits apart from a rearward end of the curved intermediate portion of the chine. The branch portion of the chine extends generally transversely across the bottom of the boat hull and divides a forward, relatively angled or sloped portion of the bottom of the hull from a rearward, relatively flat portion of the bottom of the hull. At least a portion of the chine may also define a lip that extends from the hull between the side portion and the bottom portion. The lip helps to deflect spray generated by the boat hull during operation of the vessel. This helps to keep occupants of the boat relatively dry.

The boat hull may also include one or more generally S-shaped strake elements. Each strake element extends from a forward portion to a rearward portion of the hull along the bottom portion of the hull. At least one primary strake in each half of the hull includes a forward end that extends above the mean waterline during normal operation of the vessel. The forward portion of the primary strake forms an angle of at least 28 degrees relative to the horizontal. The branch portion of the chine segment typically extends between the curved intermediate portion of the chine and the primary strake element. The strake elements also help to deflect and reduce boat spray.

It should be understood that, as used herein, "mean waterline" means the point at which the chine segment intersects the waterline while the vessel carrying an average load is either stationary or moving at a slow or idle speed within the water. During stationary, idle or slow operation and use of the hull, and under varying loads the waterline will rise and decrease somewhat between high and low waterlines. The mean waterline should be considered the average level of the water relative to the hull.

BRIEF DESCRIPTION OF THE DRAWINGS

Other objects, features and advantages will occur from the following description of a preferred embodiment and the accompanying drawings, in which.

Figure 1:
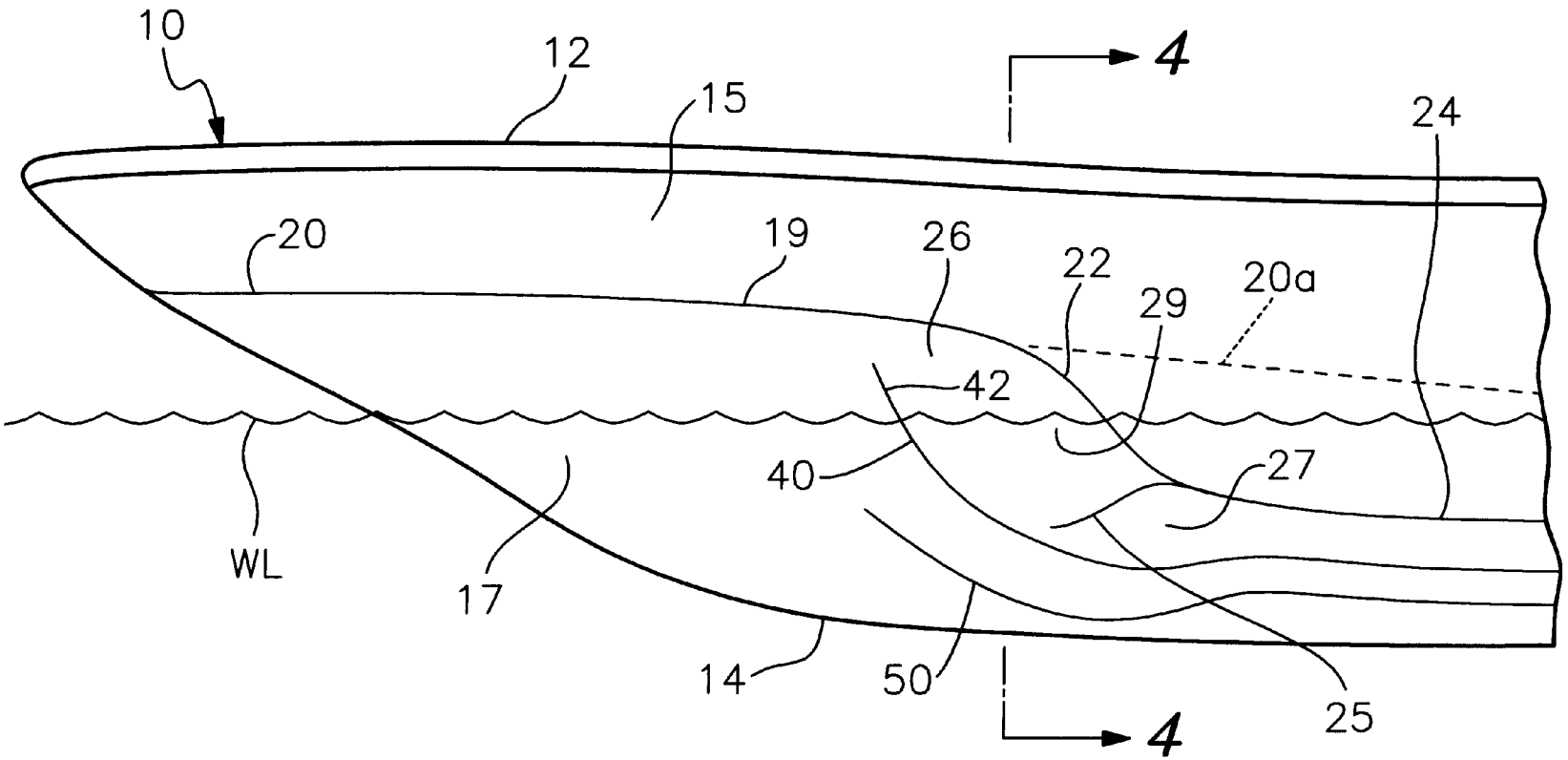
FIG. 1 is an elevation side view of a shallow water fishing boat hull that is constructed in accordance with this invention.
Figure 2:
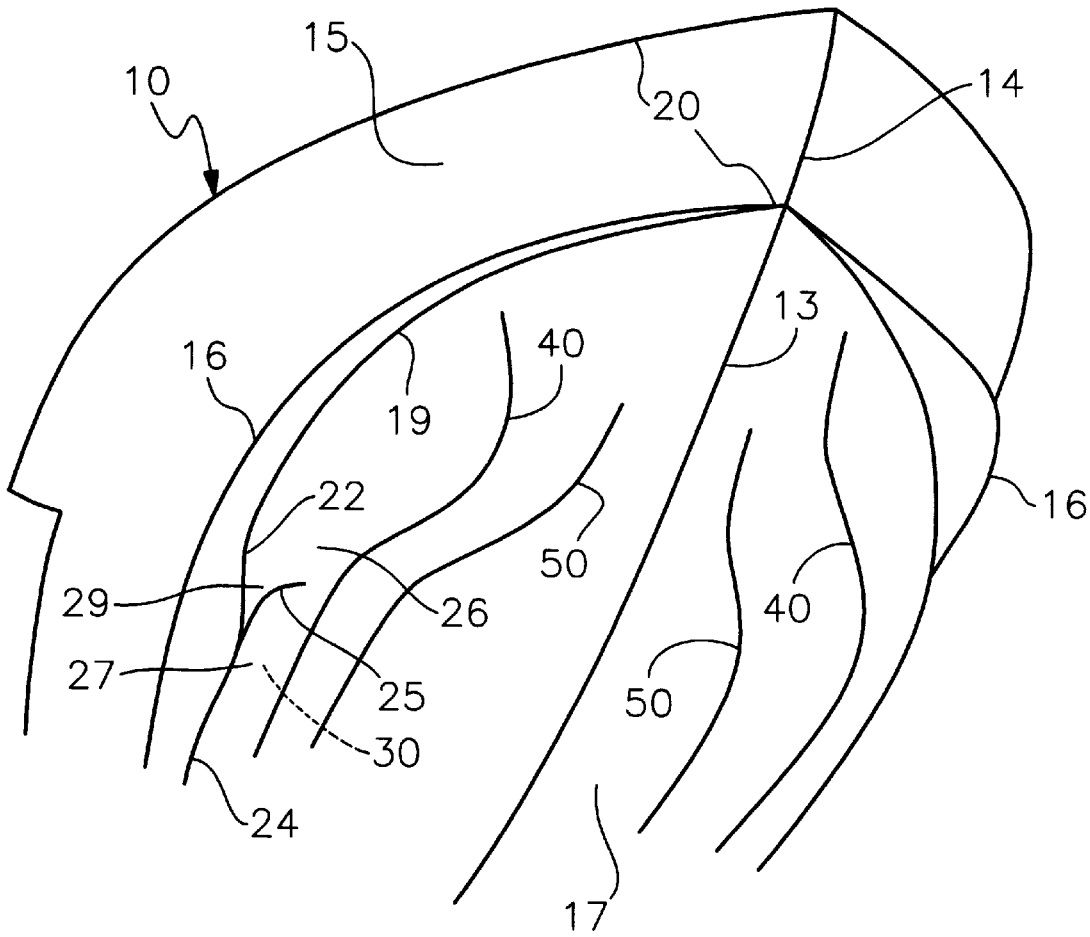
FIG. 2 is a bottom perspective view of the hull.

There is shown in FIGS. 1 through 4 a boat hull 10 that is designed for use in shallow water applications such as fishing. The forward or bow end of the hull is depicted in FIGS. 1 and 2. Hull 10 includes a standard upper interior 12 (which includes the deck, not shown) and a keel 13 that extends from the bow 14 to the stem of the hull in a standard manner. A spray rail 16, best shown in FIG. 2, extends rearwardly from the bow, about both sides of the hull. In conventional boats, spray rail 16 also forms a chine that divides the boat hull into side and bottom surfaces 15 and 17, respectively. In the present apparatus, hull 10 includes a pair of chine segments 19 that diverge from spray rail 16 along respective sides of the hull. Each chine segment 19 features an identical configuration. Accordingly, the chine segment that extends along one representative side of the hull will be described herein. It should be understood that the other side of the hull employs a chine segment that is shaped and operates in an analogous manner.

Each chine segment 19 has an elongate, generally S-shaped configuration. The chine segment comprises a molded portion of the hull that projects outwardly from the hull and essentially forms a lip projecting therefrom. Forward portion 20 of chine segment 19 extends forwardly to a point touching or at least proximate to bow 14. An intermediate, sharply curved portion 22 of chine segment 19 sweeps downwardly and rearwardly from section 20. When the boat hull is disposed in a body of water, curved portion 22 is intersected by mean waterline WL, as best shown in FIG. 1. A rearward portion 24 of the S-shaped chine segment is connected to curved portion 22 and extends rearwardly therefrom. Portion 24 generally traces the length and curvature of boat hull 10 and terminates at or proximate to the stem of the vessel.

Figure 3:
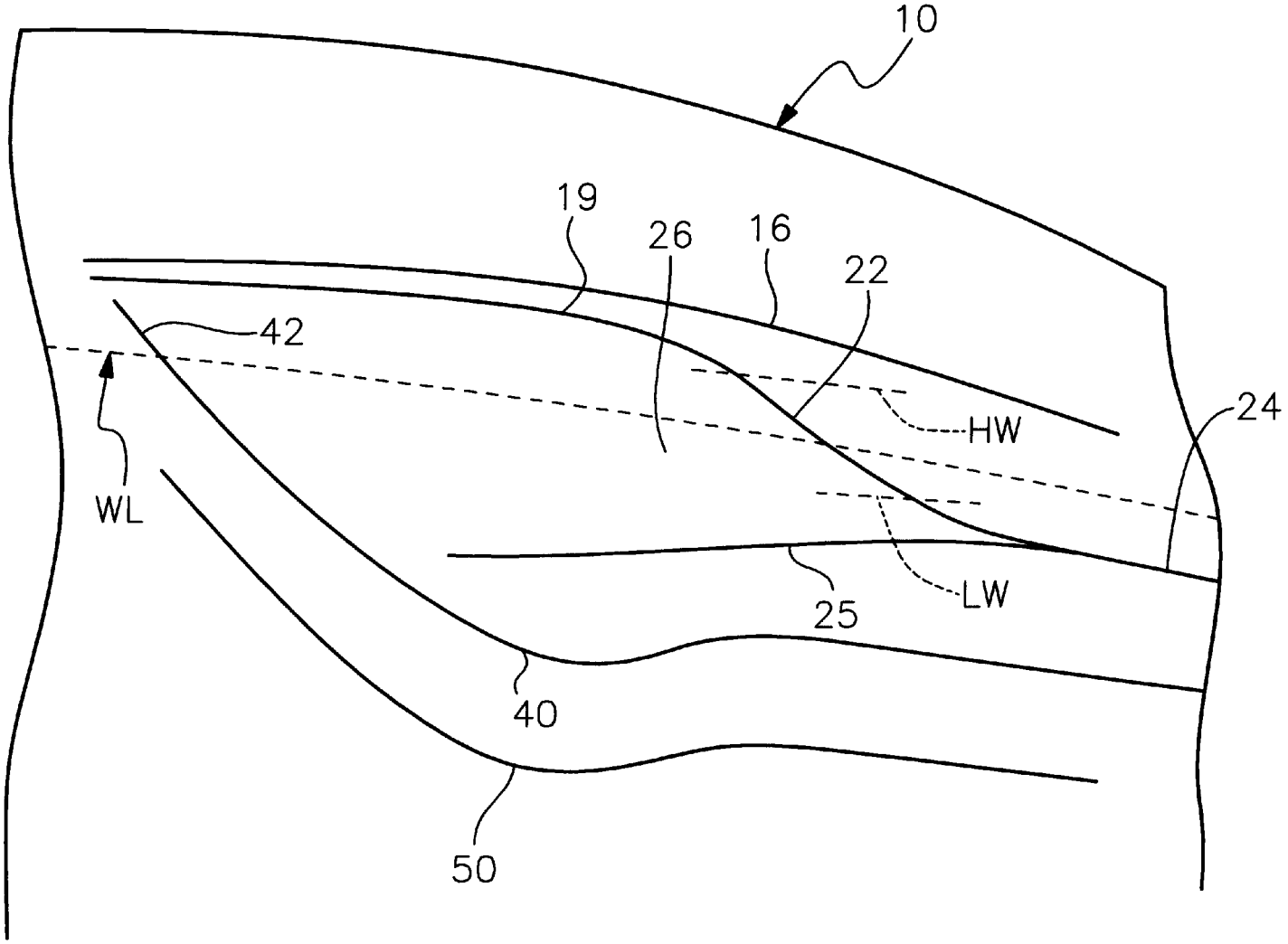
FIG. 3 is a bottom perspective view of one side of the hull specifically illustrating the split chine construction and generally Shaped strakes.
Figure 4:
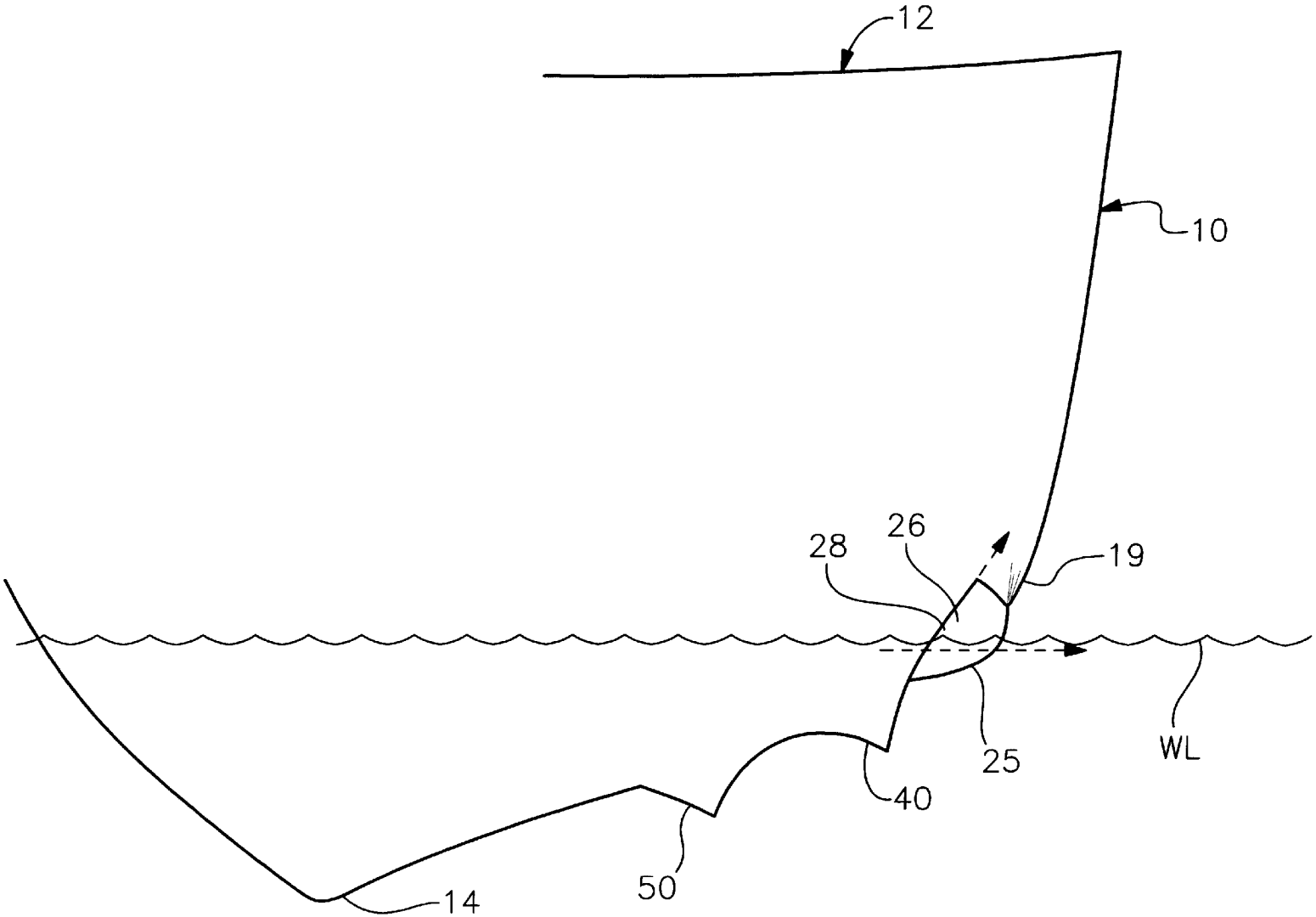
FIG. 4 is a cross sectional view of one-half of the boat hull taken along line 4—4 of FIG. 1.

This invention features a unique split chine construction. A branch chine portion 25 extends from a point in chine segment 19 proximate the lower end of curved portion 22. Chine portion 25 extends in a generally transverse direction across the bottom 17 of boat hull 10. A relatively flat region 27 of bottom surface 17 is located aft of chine portion 25 and below chine portion 24. A sloped region 29 of hull portion 17 is located forwardly of portion 25 and immediately adjacent chine portion 22. Region 27 includes an angle (relative to the waterline) that is much shallower than the angle that region 29 forms with the plane of the water. The split chine segment 19 effectively defines a pocket 26 in the bottom surface 17 of boat hull 10. As shown in FIGS. 1, 3 and 4, pocket 26 is disposed partially above and partially below the mean waterline WL. Boat hull bottom 17 intersects the horizontal plane effectively defined by the mean waterline (i.e. the plane defined by the waterline in the theoretical absence of waves, ripples or other vertical surface motion) such that the walls of pocket 26 form an angle 28, FIG. 4, with the mean waterline WL. Angle 28 is at least 26° and preferably no greater than 34°. A similar angle should apply regardless of where the waterline intersects chine segment 19, i.e. either relatively high (dashed line HW) or relatively low (dashed line LW) along intermediate curved portion 22. See FIG. 3. Because the bottom of the hull maintains this fairly steep angle with the surface of the water, waves and ripples tend not to slap loudly against the bottom of the boat. Noise is significantly reduced and fish are not scared away from the vessel.

It should be noted that, as shown in FIG. 1, conventional shallow water boats employ a chine that generally follows forward chine portion 20 and dashed extension 20*a*. In such vessels, the bottom of the boat intersects the waterline far aft of the point that curved chine portion 22 of hull 10 intersects mean waterline WL. Conventional chine portion 20*a* also intersects the water at a very shallow angle. Waves and ripples accordingly slap against the shallow angled bottom of the hull and cause considerable noise, which tends to scare fish. In the present invention, it is significant that the relatively flat section 27 of hull bottom 17, which is disposed behind chine segment 22, is located entirely beneath the mean waterline WL and remains submerged regardless of the load contained within the boat. This relatively flatter, shallow angled bottom portion 27 is not loudly slapped by waves or ripples and does not contribute significantly to fish distracting noise.

As best shown in FIG. 4, chine segment 19 projects outwardly from the hull 10 and essentially forms a spray deflecting lip. As the boat hull moves through the water, spray is intercepted by this lip and prevented from entering into the boat. As a result, much drier vessel interior is achieved.

Boat hull 10 also features a pair of generally S-shaped strakes 40 and 50 formed along each side of hull bottom 17. Various numbers of strakes may be employed in accordance with this invention. Each strake is molded permanently into the bottom of hull 10 and projects from the hull as best shown in cross section of FIG. 4. A primary strake 40 is disposed adjacent to chine segment 19. A somewhat shorter secondary strake 50 is disposed between strake 40 and keel 13.

As best shown in FIGS. 1 and 3 a forward end 42 of primary strake 40 intersects mean waterline WL and extends at a relatively sharp angle above the waterline. This angle is preferably at least about 28 degrees. Chine portion 25 extends transversely across bottom 17 of hull 10 between the junction of chine portions 22 and 24 and a curved intermediate portion of primary strake 40.

The strakes help to maneuver the boat in a known manner. They also help to deflect the spray from the interior of the vessel. Spray reduction is particularly effective due to the forward end of 42 of primary strake 40 extending above the mean waterline. By the same token, the strakes are uniquely curved so that they are located primarily below the waterline during fishing (i.e. while the boat is stopped or moving at slow, idle and other non-planing speeds). This significantly reduces the amount of exposed boat hull bottom and, as a result, further lessens unwanted water slapping and hull noise. The use of the projecting lip or rail formed by the chine segment in combination with the strakes achieves especially improved spray reduction and provides for a much drier boating experience.

Accordingly, the sharp intermediate slope formed by the chine segment of the present invention is much more effective in resisting unwanted hull noise then the gently sloped chine employed by the prior art. The steep angle that the bottom surface of the hull forms with the water due to the sharply curved intermediate section 22 of chine segment 19 creates a void or pocket that significantly reduces slapping of water against the bottom of the hull. This, in turn, significantly reduces noise that is distracting to fish. The lip configuration exhibited by the chine and S-shaped strakes help to significantly reduce, if not eliminate, boat spray.

Although specific features of the invention are shown in some of the drawings and not others, this is for convenience only, as each feature may be combined with any and all of the other features in accordance with this invention.

Other embodiments will occur to those skilled in the art and are within the following claims:

What is claimed is:

1. A noise reducing boat hull for use in a body of water, said boat hull comprising:

a keel that extends generally between a bow and a stem of the hull and divides the hull into a pair of substantially similar half sections;

each said half section including an upper side surface and a bottom surface, which surfaces are separated by a generally longitudinal chine segment, said chine segment including a forward chine portion extending rearwardly from a cation proximate the bow, a rearward chine portion extending forwardly from a location proximate the stem and an intermediate chine segment interconnecting said forward and rearward chine segments and extending rearwardly and downwardly from said forward chine segment and upwardly and forwardly from said rearward chine segment;

said bottom surface including a relatively flat aft region located adjacent to said rearward chine portion and entirely below the mean waterline when the hull is disposed in the body of water, and a relatively sloped forward region located adjacent said intermediate chine portion and connected to said relatively flat aft region at an upwardly extending angle, said relatively sloped forward region of said bottom surface and said intermediate chine portion intersecting and extending at least partly above the horizontal plane effectively defined by the mean waterline, whereby the force of waves impacting against said bottom surface of the hull and the noise resulting from such impact are reduced.

2. The hull of claim 1 in which said intermediate chine portion and said forward region of said bottom surface of the hull intersect the horizontal plane of the body of water at an angle of at least 26°.

3. The hull of claim 1 in which the intermediate chine segment and said forward portion of said bottom surface intersect the horizontal plane of the body of water at an angle of between 28° and 34°.

4. The hull of claim 1 in which said chine segment further includes a branch portion connected to and diverging from a rearward end of said intermediate chine portion, said branch portion extending generally transversely across said bottom surface of said boat hull and dividing said sloped region from said relatively flat region.

5. The hull of claim 4 in which said intermediate chine segment, said branch segment and said sloped forward region of said bottom surface define a pocket in said bottom surface of the hull, said pocket intersecting the horizontal plane of the body of water in which the hull is disposed.

6. The hull of claim 4 in which said bottom surface includes a generally undulating primary strake that extends longitudinally along said bottom surface and having a forward end portion that intersects and extends above the mean waterline of a body of water in which said hull is disposed, said branch chine segment being interconnected to a curved middle portion of said primary strake.

7. The hull of claim 6 in which said forward portion of said primary strake intersects the mean waterline at an angle of at least 28°.

8. The hull of claim 1 in which at least a part of said segment defines a lip that extends outwardly from said hull between said upper side surface and said bottom surface, said lip deflecting spray generated by the boat hull as the hull moves through the body of water.

9. The hull of claim 1 further including a plurality of generally undulating strakes that extend generally longitudinally along said bottom surface of the hull between the bow and the stern.

10. The hull of claim 9 in which each said strake is molded to said bottom surface of the hull.

11. The hull of claim 1 in which said bottom surface includes a generally undulating primary strake that extends generally longitudinally along said bottom surface of the hull, said primary strake having a forward end portion that intersects and extends above the mean waterline of the body of water in which the hull is disposed.

12. The hull of claim 11 in which said primary strake intersects the mean waterline at an angle of at least 28°.

13. The hull of claim 11 further including at least one generally undulating secondary strake that extends generally longitudinally along said bottom surface of the hull and which is disposed between said primary strake and said keel of the hull, each said secondary strake remaining below the mean waterline of the body of water in which the hull is disposed.

14. A noise reducing boat hull for use in a body of water, said boat hull comprising:

a keel that extends generally between a bow and a stem of the hull and divides the hull into a pair of substantially similar half sections;

each said half section including an upper side surface and a bottom surface, which surfaces are separated by a generally longitudinal chine segment, said chine segment including a forward chine portion extending rearwardly from a location proximate the bow, a rearward chine portion extending forwardly from a location proximate the stern and an intermediate chine segment interconnecting said forward and rearward chine segments and extending rearwardly and downwardly from said forward chine segment and upwardly and forwardly from said rearward chine segment;

said bottom surface including a relatively flat aft region located adjacent to said rearward chine portion and entirely below the mean waterline when the hull is disposed in the body of water, and a relatively sloped forward region located adjacent said intermediate chine portion and connected to said relatively flat aft region at an upwardly extending angle, said relatively sloped forward region of said bottom surface and said intermediate chine portion intersecting and extending at least partly above the horizontal plane effectively defined by the mean waterline, whereby the force of waves impacting against said bottom surface of the hull and the noise resulting from such impact are reduced; said chine segment further including a branch portion connected to and diverging from a rearward end of said intermediate chine portion, said branch portion extending generally transversely across said bottom surface of said boat hull and dividing said sloped region from said relatively flat region.

15. A noise reducing boat hull for use in a body of water, said boat hull comprising:

a keel that extends generally between a bow and a stem of the hull and divides the hull into a pair of substantially similar half sections;

each said half section including an upper side surface and a bottom surface, which surfaces are separated by a generally longitudinal chine segment, said chine segment including a forward chine portion extending rearwardly from a location proximate the bow, a rearward chine portion extending forwardly from a location proximate the stem and an intermediate chine segment interconnecting said forward and rearward chine segments and extending rearwardly and downwardly from said forward chine segment and upwardly and forwardly from said rearward chine segment;

said bottom surface including a relatively flat aft region located adjacent to said rearward chine portion and entirely below the mean waterline when the hull is disposed in the body of water, and a relatively sloped forward region located adjacent said intermediate chine portion and connected to said relatively flat aft region at an upwardly extending angle, said relatively sloped forward region of said bottom surface and said intermediate chine portion intersecting and extending at least partly above the horizontal plane effectively defined by the mean waterline, whereby the force of waves impacting against said bottom surface of the hull and the noise resulting from such impact are reduced; at least a part of said chine segment defining a lip that extends outwardly from said hull between said upper side surfaces and said bottom surface, said lip deflecting spray generated by the boat hull as the hull moves through the body of water.

16. A noise reducing boat hull for use in a body of water, said boat hull comprising:

a keel that extends generally between a bow and a stem of the hull and divides the hull into a pair of substantially similar half sections;

each said half section including an upper side surface and a bottom surface, which surfaces are separated by a generally longitudinal chine segment, said chine segment including a forward chine portion extending rearwardly from a location proximate the bow, a rearward chine portion extending forwardly from a location proximate the stem and an intermediate chine segment interconnecting said forward and rearward chine segments and extending rearwardly and downwardly from said forward chine segment and upwardly and forwardly from said rearward chine segment;

said bottom surface including a relatively flat aft region located adjacent to said rearward chine portion and entirely below the mean waterline when the hull is disposed in the body of water, and a relatively sloped forward region located adjacent said intermediate chine portion and connected to said relatively flat aft region at an upwardly extending angle, said relatively sloped forward region of said bottom surface and said intermediate chine portion intersecting and extending at least partly above the horizontal plane effectively defined by the mean waterline, whereby the force of waves impacting against said bottom surface of the hull and the noise resulting from such impact are reduced; and a plurality of generally undulating strakes that extend longitudinally along said bottom surface of the hull between the bow and the stem on one of said half sections and a second plurality of generally undulating strakes that extend generally longitudinally along said bottom surface of the hull between the bow and the stem on said other half section, at least one said strake in each plurality having a forward end that intersects and extends above the mean water line of the body of water in which the hull is disposed.

* * * * *

UNITED STATES PATENT AND TRADEMARK OFFICE

CERTIFICATE OF CORRECTION

PATENT NO. : 6,234,104 B1
DATED : January 24, 2000
INVENTOR(S) : Paul Guard

It is certified that error appears in the above-identified patent and that said Letters Patent is hereby corrected as shown below:

Column 3,
Line 8, change "stem" to -- stern --;

Column 5,
Line 4, change "stem" to -- stern --;
Line 11, change "cation" to -- location --;
Line 13, change "stem" to -- stern --;

Column 6,
Lines 21, 56 and 65, change each occurrence of "stem", to -- stern --;

Column 7,
Line 23, change "stem", to -- stern --;

Column 8,
Lines 1, 23 and 27, change each occurrence of "stem", to -- stern --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*